United States Patent [19]

Bald

[11] Patent Number: 4,635,462

[45] Date of Patent: Jan. 13, 1987

[54] CORRUGATING DIE SHOE ASSEMBLIES

[75] Inventor: Gordon H. Bald, Lockport, N.Y.

[73] Assignee: Diversified Manufacturing Corporation, Lockport, N.Y.

[21] Appl. No.: 780,647

[22] Filed: Sep. 26, 1985

[51] Int. Cl.[4] ..... B21D 13/02

[52] U.S. Cl. ..... 72/385; 72/414; 72/416

[58] Field of Search ..... 72/385, 414, 416; 493/463

[56] References Cited

U.S. PATENT DOCUMENTS

| | | | |
|---|---|---|---|
| 1,771,028 | 12/1928 | Bronson et al. | 72/385 |
| 2,481,049 | 9/1949 | Stamm et al. | 72/385 |
| 3,340,719 | 9/1967 | Kandle et al. | 72/385 |
| 3,628,369 | 12/1971 | Williamson | 72/385 |
| 3,748,889 | 7/1973 | Miller et al. | 72/385 |

FOREIGN PATENT DOCUMENTS

| | | | |
|---|---|---|---|
| 5300 | 3/1965 | Japan | 72/385 |
| 158836 | 12/1980 | Japan | 72/385 |
| 2120142 | 11/1983 | United Kingdom | 72/385 |

*Primary Examiner*—Francis S. Husar
*Assistant Examiner*—David B. Jones
*Attorney, Agent, or Firm*—Christel, Bean & Linihan

[57] ABSTRACT

A sheet metal corrugating apparatus provided with novel upper and lower corrugating die shoe assemblies which can simultaneously corrugate all corrugations in a single piece of relatively thick steel sheet to produce a relatively flat corrugated sheet within prescribed dimensional tolerances. Each of the novel upper and lower die shoe assemblies include a plurality of individually shiftable corrugating dies mounted upon a primary bed member in such a manner that they can shift towards and away from each other, guide bars fixedly mounted on the primary bed member between the corrugating dies, and springs extending between the guide bars and shiftable dies and which bias the corrugating dies apart to their greatest extent when the die shoe assemblies are in their open position.

7 Claims, 6 Drawing Figures

Fig. 2.
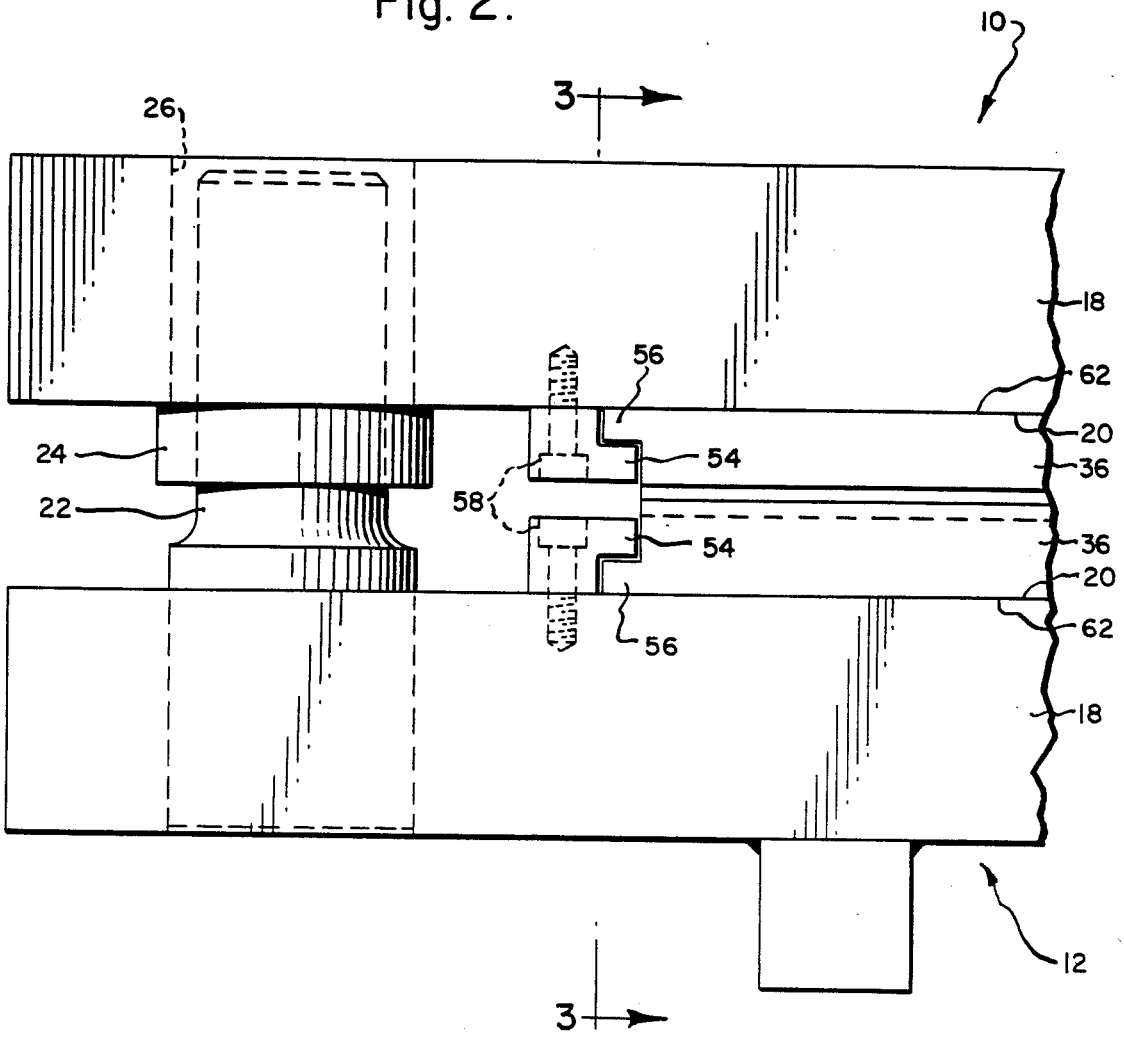
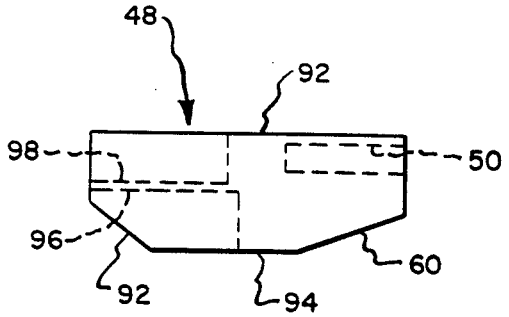
Fig. 6.

CORRUGATING DIE SHOE ASSEMBLIES

FIELD OF THE INVENTION

The present invention relates generally to sheet metal corrugating apparatus, and more particularly to a novel corrugating die shoe assembly which can simultaneously corrugate all corrugations in a single piece of relatively thick steel sheet to a relatively flat corrugated sheet within prescribed dimensional tolerances, and which requires no more press tonnage than when the same relatively thick steel sheet was partially corrugated with prior corrugating dies.

BACKGROUND

When producing a plurality of corrugations (such as nine) in a relatively heavy sheet metal, for example ten gage, it has been customary in the past to place the steel sheet between upper and lower corrugating die shoe assemblies, each of which is provided with two fixed corrugating dies. A relatively heavy press supports the die shoe assemblies and when it is operated only two corrugations are formed in the sheet material at one time. Thus, it has been necessary to make a plurality of successive hits on the sheet metal which is being corrugated, one hit for each pair of corrugations. This procedure has had a number of disadvantages in that it is time consuming, requires a skilled press operator, and frequently produces a product which is neither dimensionally accurate nor flat. In the prior process the sheet material was drawn as well as bent by the corrugating operation. The stresses imposed upon the sheet material during the combined metal working operation frequently caused the fully corrugated sheet to be warped. Thus, a further straightening operation after the corrugating operation was frequently required. In addition, the product produced by the prior art process was not always within dimensional tolerance which prevented accurate spot welding of corrugation to mating parts.

OBJECTS AND SUMMARY OF THE INVENTION

It is an object of the present invention to provide a pair of upper and lower corrugating die shoe assemblies which can be mounted within a press for movement towards and away from each other between open loading and unloading positions and closed corrugating positions, which corrugating die shoe assemblies are capable of forming all corrugations in a single relatively thick steel sheet with no greater press tonnage than that previously required when only a portion of the corrugations were produced at one time, the final workpiece produced by the novel corrugating die shoe assemblies of this invention being within prescribed dimensional tolerances and relatively flat.

The above object and other objects and advantages of the present invention are accomplished by providing novel upper and lower corrugating die shoe assemblies. Each of the upper and lower corrugating die shoe assemblies has a primary bed member which in turn has a bearing surface disposed adjacent the other corrugating die shoe assembly when assembled into a press. A fixed corrugating die is nonshiftably mounted on the surface of only one of the primary bed members. The corrugating die shoe assemblies are additionally provided with a plurality of individually shiftable corrugating dies which are spring biased apart to their greatest extent when the corrugating die shoe assemblies are in their open position with the shiftable corrugating dies bearing against a plurality of guide bars which are fixedly mounted on the bearing surface.

The above will be more fully understood after a consideration of the following detailed description taken in conjunction with the accompanying drawings in which a preferred form of this invention is illustrated.

BRIEF DESCRIPTION OF THE VARIOUS FIGURES

FIG. 2 is an enlarged view taken generally along the line 2—2 in FIG. 1 and showing additional parts of the lower corrugating die shoe assembly and the upper corrugating die shoe assembly.

FIG. 6 is an end view of the die shown in FIG. 5.

DETAILED DESCRIPTION

Figure 3:
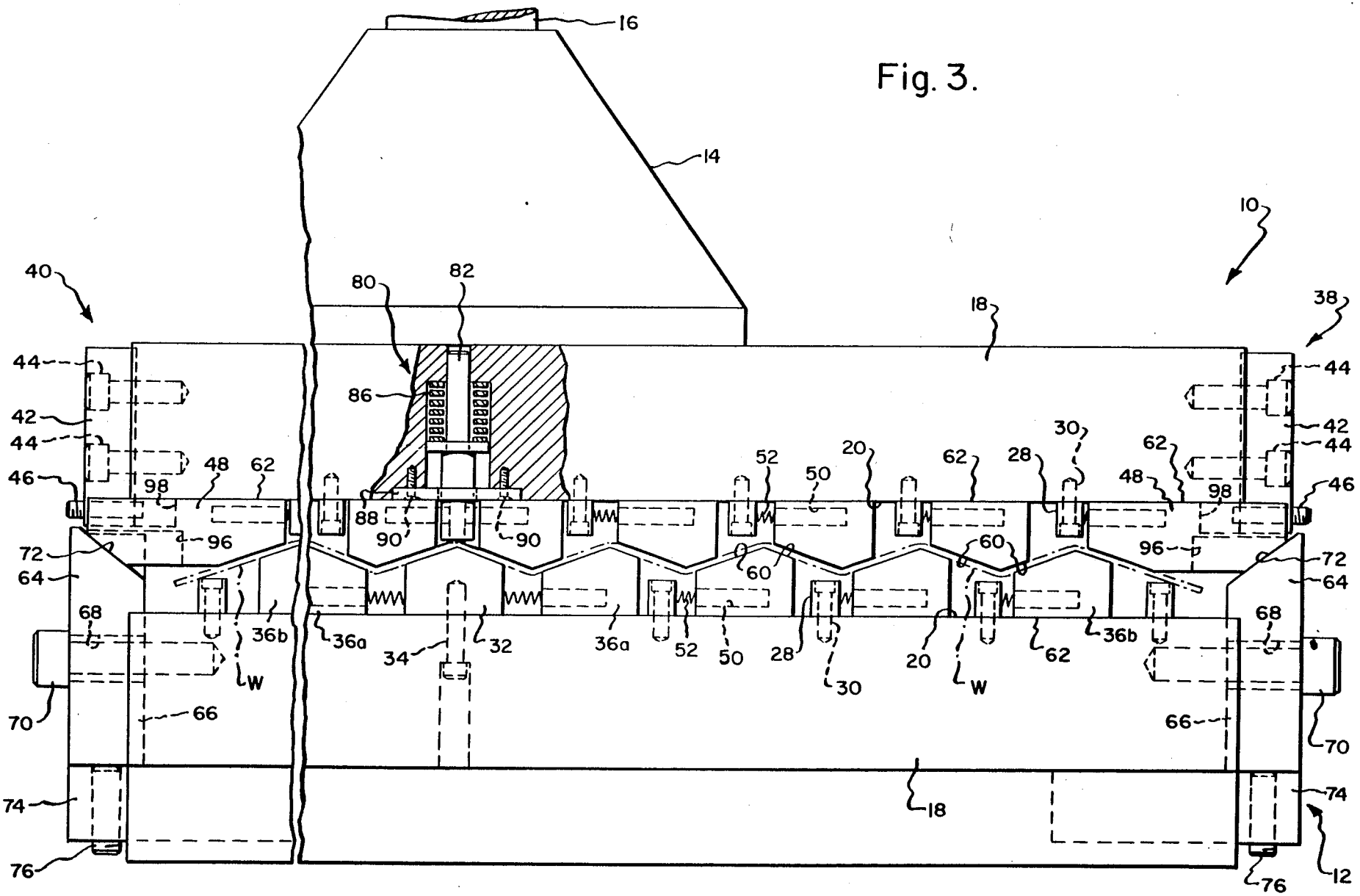
FIG. 3 is a sectional view taken generally along the line 3—3 in FIG. 1, the upper and lower corrugating die shoe assemblies of this invention being shown mounted in a press and in their closed position, parts being broken away for purposes of clarity.
Figure 4:
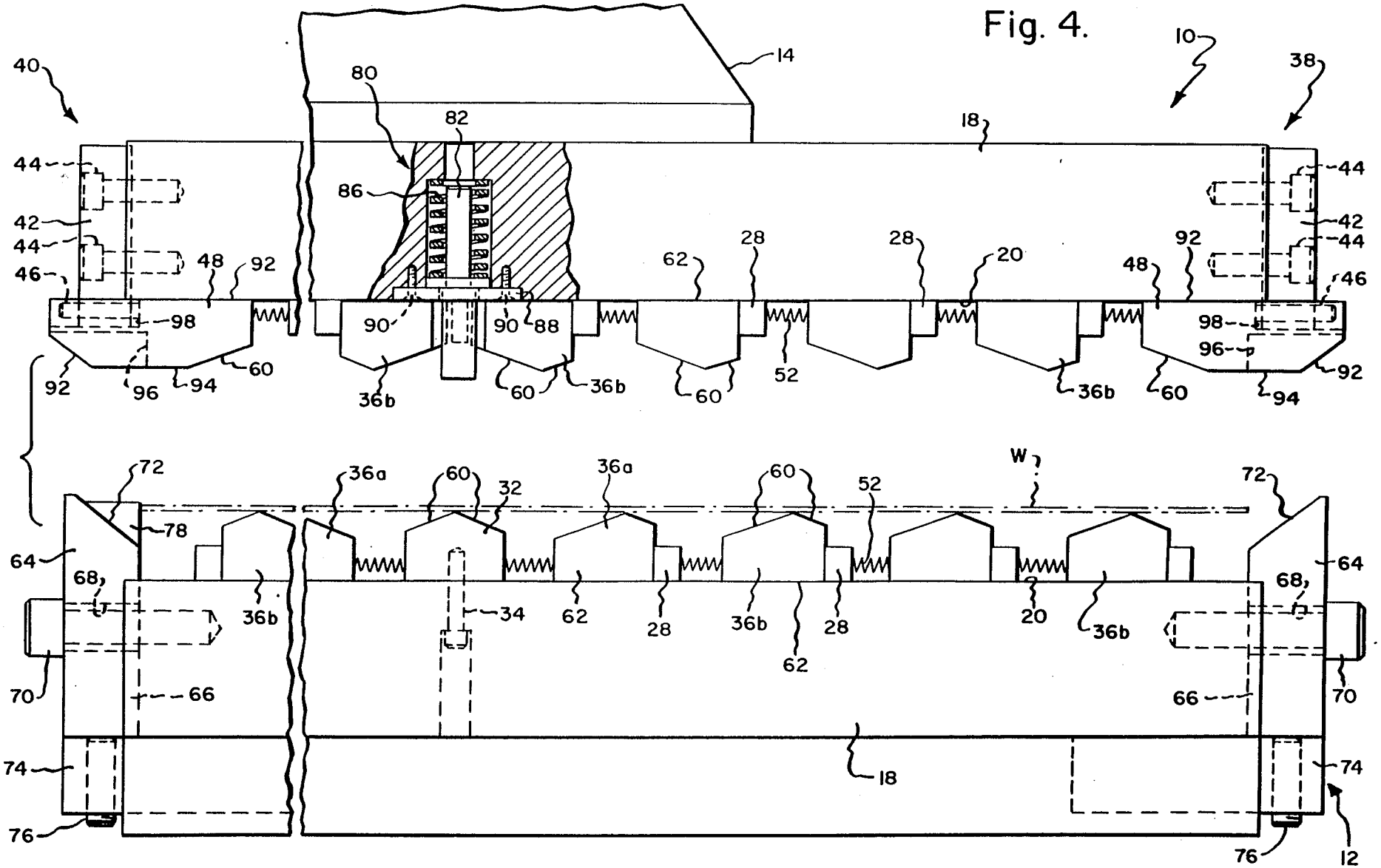
FIG. 4 is a partial view corresponding to FIG. 3 showing the upper and lower corrugating die shoe assemblies when in their open position.

Referring first to FIGS. 3 and 4, the upper and lower corrugating die shoe assemblies of this invention are indicted generally at 10 and 12, respectively. The die shoe assemblies are in turn carried by press means for movement between an open loading and unloading position, as shown in FIG. 4, and a closed corrugating position shown in FIG. 3. The press means per se forms no part of this invention and is represented in FIG. 3 merely by the mounting structure 14 which interconnects the upper corrugating die shoe assembly with a hydraulic cylinder indicated by the rod 16. The lower corrugating die shoe assembly could be of course mounted on a rod for movement towards and away from the upper corrugating die shoe assembly, and can also be simply mounted on a bed of the press.

As the upper and lower corrugating die shoe assemblies have many similar parts, common reference numerals will be applied to similar parts on each of these members. Thus, each of the upper and lower corrugating die shoe assemblies has a principal bed member 18, the bed member in turn having a bearing surface 20 disposed adjacent the other corrugating die shoe assembly when assembled into the press means. As can best be seen from FIGS. 1 and 2, the bed members are provided with guide posts 22 and bushings 24 which receive the upper cylindrical ends of the guideposts. As shown in the drawings, the guideposts are mounted on the primary bed member 18 of the lower corrugating die shoe assembly 12 and the bushings 24 are received within cylindrical apertures 26 on the upper corrugating die shoe assembly 10. The guideposts and bushings, as are well known in the art, insure that the upper and lower portions of the corrugating die shoe assemblies will be maintained in alignment with each other.

In accordance with this invention, a plurality of guide bars 28 are secured to the bearing surface 20 of the associated primary bed member 18 by fasteners 30. The guide bars are parallel to each other and are spaced apart from each other at a prescribed distance so selected that the corrugations formed on the workpiece W, which may be 10 gage steel, will be formed within prescribed dimensional tolerances. In addition to the various guide bars 28, a fixed corrugating die 32 is non-shiftably mounted on the bearing surface of one of the corrugating die shoe assemblies, which is the lower corrugating die shoe assembly as illustrated. This fixed corrugating die is held in its prescribed location by fasteners 34. As can be seen from an inspection of FIGS. 1 and 3, this die is centrally located. Spaced between the fixed corrugating die 32 and the adjacent guide bars 28 are a pair of individual shiftable corrugating dies 36*a*. Extending between all of the other guide bars are additional shiftable corrugating dies 36*b*, which are substantially identical to the dies 36*a*. There is one shiftable corrugating die 36*b* between each pair of adjacent guide bars 28, with the exception of those shiftable corrugating dies 36*b* which are adapted to cooperate with the fixed corrugating die 32, in this case there being two shiftable corrugating dies 36*b* disposed between adjacent guide bars.

In addition to the various guide bars 28 referred to above, front and rear guide assemblies 38, 40, respectively are provided, these guide assemblies being mounted on the front and rear sides of a primary bed member. In the embodiment illustrated, these guide assemblies are mounted on the primary bed member 18 of the upper corrugating die assembly. However, it should be appreciated that if a different numbering of corrugations were to be formed, these final guide assemblies may be on the primary bed member associated with the fixed corrugating die. Each of the front and rear guide assemblies includes a support bar 42 which is secured to the side of the associated primary bed member by fasteners 44, and an adjustable threaded element 46. Disposed between the front and rear guide assemblies 38, 40 and the immediately adjacent guide bars 28 are shiftable corrugating dies 48 of somewhat differing construction than the corrugating dies 36. One side of each of the shiftable corrugating dies 36 and 48 is provided with cylindrical recesses 50, each of which receives one end of a coil spring 52. The other ends of each coil spring bears against an adjacent guide bar or guide assembly forcing the other side of the shiftable die into contact with an associated guide bar 28 when the corrugating die shoe assemblies are in their open positions as can be seen from FIG. 4. The guide bars and guide assemblies are spaced predetermined selected distances apart to insure that when the corrugating die shoe assemblies are brought from their open position to their closed position, virtually no drawing of the workpiece will take place during the forming of the corrugated sheet, and that only bending take place at the crests of the corrugation. The spring associated with the two shiftable corrugating dies 36*b* which are adapted to cooperate with the fixed corrugating die 32 extend from the recess in one shiftable die to the recess in the other shiftable die. These springs are preferably of slightly greater length than the other springs utilized in this design.

Figure 1:
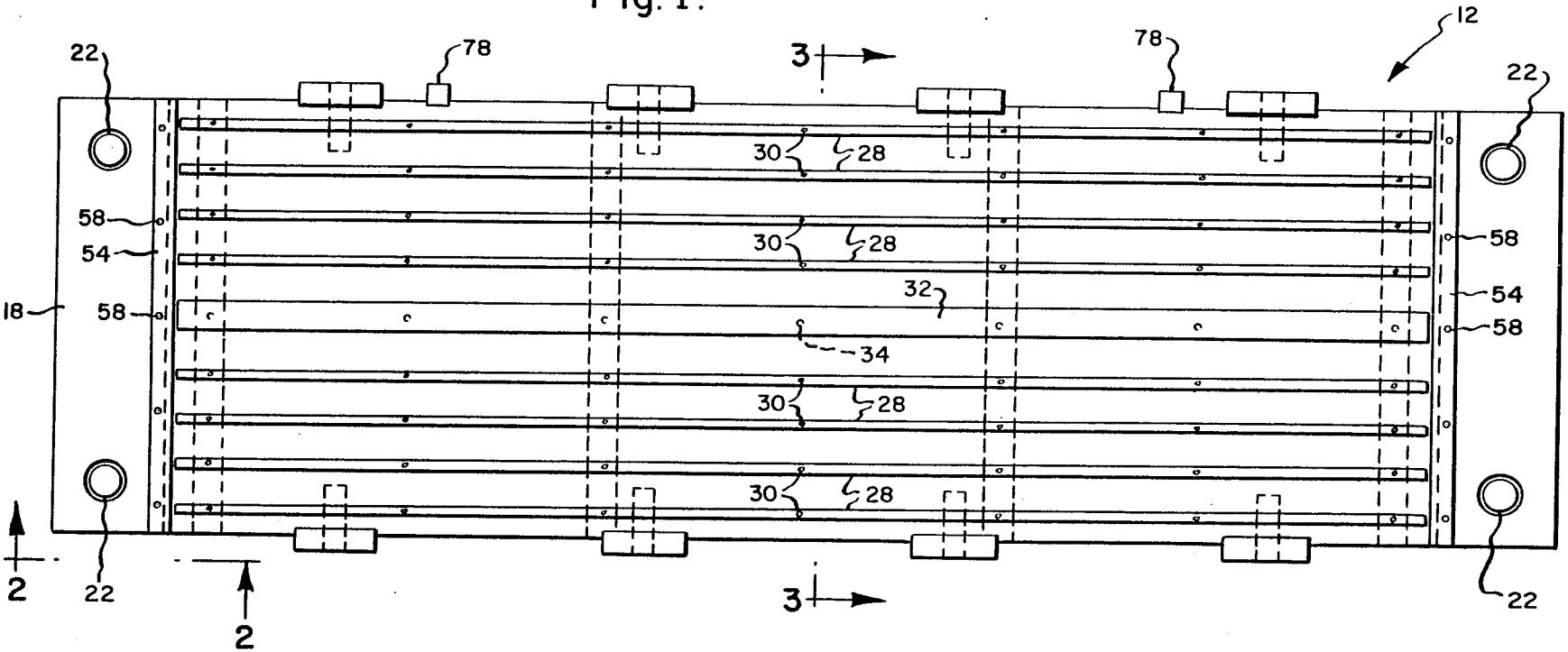
FIG. 1 is a plan view of the primary bed member and guide bars of the lower corrugating die shoe assembly.
Figure 5:
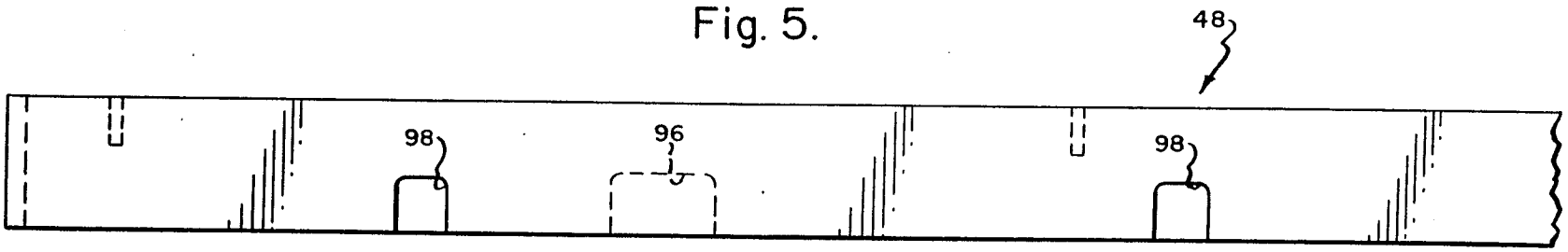
FIG. 5 is a plan view of one of the outermost shiftable corrugating dies.

The shiftable corrugating dies 36 and 48 are maintained in juxtapositioned relationship to the surface 20 of the associated primary bed member 18 by means of mounting members 54, see FIGS. 1 and 2. The mounting members are L-shaped brackets, there being a pair of L-shaped brackets mounted on each primary bed member 18 at the ends of the associated shiftable corrugating dies 36, 48 with that leg of the L-shaped bracket which is generally parallel to the bearing surface 20 overhanging a reduced height end portion 56 of the associated shiftable corrugating die. The L-shaped brackets 54 are in turn held in place on the associated primary bed member 18 by fasteners 58.

Each of the shiftable corrugating dies 36 and the fixed die 32 is provided with working surfaces 60 which are adapted to contact the sheet metal workpiece W during the corrugating operation. The workpiece will be placed upon the crests of the lower shiftable corrugating dies and the fixed corrugating die when the press is open, the crests being formed by the intersection of two working surfaces 60. Disposed to the other side of each shiftable corrugating die is a flat surface 62. In order to reduce the friction between the flat surface 62 and the bearing surface 20 of the primary bed member 18, the surface 20 is coated with a reduced friction coating material, preferably tetrafluoroethylene.

Spaced apart ramps are mounted on the lower primary bed member 18 to opposite sides of the guide bars 28. To this end, the lower primary bed member 18 is provided with vertically extending slots which receive the ramps 64 for vertical sliding movement, the ramps having a generally rectangular cross section. The ramps are in turn provided with another slot 68, and are held in place by a cap screw 70 which passes through the slot 68 and is received within a threaded aperture in the primary bed member. Each ramp 64 is provided with a downwardly and inwardly extending ramp surface 72 which facilitates the shifting of the shiftable corrugating dies in a manner which will be more fully set forth below. However, it should be noted that the ramp surface 72 should be precisely located and should not shift during the formation of corrugations in the workpiece W. To this end, a bar 74 is welded or otherwise rigidly secured to the bottom of the lower primary bed member 18, the outwardly extending end of the bar 74 being provided with a vertically extending threaded aperture which receives a set screw 76. The screw is brought to bear against the lower surface of the ramp 64 when it is in its desired operating position to prevent the ramp from shifting downwardly during operation. In addition to the ramps 64, the lower die is also provided with stops 78 disposed at the back of the die and which are contacted by the workpiece W when it is being installed into the assembly prior to corrugation.

In the embodiment illustrated, the upper corrugating die shoe assembly 10 is provided with hold down means indicated generally at 80. While only one hold down means is illustrated in the various figures, in the embodiment illustrated in the drawings in fact four separate hold down means are utilized. Each of the hold down means consists of a shouldered rod 82. The rod receives a coil spring 86 which bears against the upper surface of the shoulder, the assembly then being installed within suitable concentric bores in the primary bed member 18, the entire assembly being held in place by a washer 88, which washer is in turn held in place by fasteners 90.

As previously noted, the front and rear shiftable corrugating dies 48 are of somewhat differing construction than the shiftable corrugating dies 36. These dies like the other dies also have cylindrical recesses 50, a flat surface 62, but they only have one working surface 60. They are, however, provided with a complementary surface 92 which engages the ramp surface 72. Disposed between the complementary surface 92 and the working surface 60 is a generally flat surface 94. Finally, the shiftable corrugating dies 48 are provided with suitable cutout portions 96 and 98. The cutouts 96 receive the material stops 78 and the cutouts 98 receive the adjustable guide stop or threaded element 46 and the associated support bar 42.

The operation of the novel corrugating die shoe assemblies is initiated when the die shoes are in their open position illustrated in FIG. 4. The operator of the press will then insert a workpiece W between the dies, one edge abutting the stops 78, the operator of the press in turn centering the sheet from side to side so that it is in its centered position. After the workpiece is suitable positioned, the press operation will then be initiated. Initially, the hold down means 80 will contact the workpiece W and hold it firmly against the crest of the fixed corrugating die 32. As the press continues to close, the complementary surface 92 will be engaged by the ramp surface 72 which will then cause the outermost shiftable corrugating dies 48 to be shifted inwardly as the press continues its downward movement. As the press continues to close, the sheet metal workpiece W will start to be corrugated and as all of the shiftable dies can shift towards the center they will do so preventing drawing of the metal and insuring that the workpiece will be flat when the operation is completed. In addition, the guide bars have previously been set at precise distances apart from each other based upon the thickness of the material to be corrugated and the angles of the corrugations so that the metal workpiece W will not shift relative to the shiftable dies during the formation of the corrugations thus insuring that accurate dimensions and no drawing of the workpiece will be achieved. After the completion of the closing (called a hit) the press will be opened and the corrugated workpiece can be removed.

While a preferred structure in which the principles of this invention have been incorporated is shown and described above, it is to be understood that the invention is not to be limited to the particular details shown and described above but that, in fact, widely differing means may be employed in the practice of the broader aspects of this invention.

What is claimed is:

1. Upper and lower corrugating die shoe assemblies in combination with press means for moving said corrugating die shoe assemblies between an open loading and unloading position and a closed corrugating position; each of said upper and lower corrugating die shoe assemblies including:

a primary bed member having a bearing surface;

a plurality of individual shiftable corrugating dies;

mounting means carried by said primary bed member for maintaining said plurality of shiftable corrugating dies in juxtapositioned relationship to said bearing surface of the primary bed member for shifting movement towards and away from each other;

a plurality of guide bars fixedly mounted on said bearing surface between said shiftable corrugating dies; and means to bias said shiftable corrugating dies apart;

one of said upper and lower corrugating die shoe assemblies further including a fixed corrugating die nonshiftably mounted on the bearing surface, the shiftable corrugating dies associated with said one corrugating die shoe assembly extending to either side of said fixed die.

2. The assemblies as set forth in claim 1 wherein the means to bias include a plurality of springs, there being at least one spring between said fixed die and an adjacent shiftable corrugating die, additional springs being disposed between said guide bars and those shiftable corrugating dies not spaced adjacent said fixed die.

3. The assemblies as set forth in claim 2 wherein each shiftable corrugating die is provided with a cylindrical recess open on one side, said springs being coil springs, and each cylindrical recess receiving and supporting a coil spring.

4. The assemblies as set forth in claim 1 wherein said bearing surface is flat and is provided with a reduced friction coating, and wherein each of said shiftable corrugating dies is provided with a complementary flat surface which is in juxtapositioned relationship to the reduced friction coating on said bearing surface.

5. The assemblies as set forth in claim 1 wherein said mounting means for each of said upper and lower corrugating die shoe assemblies is a pair of L-shaped brackets mounted on the associated primary bed member, an end portion of the shiftable corrugating dies being disposed between the bearing surface of the primary bed member and a leg of the L-shaped bracket which is generally parallel to the bearing surface to thereby retain said corrugating dies in juxtapositioned relationship to said bearing surface.

6. The assemblies as set forth in claim 1 wherein the other one of said upper and lower corrugating die shoe assemblies is provided with hold down means capable of maintaining the sheet to be corrugated in contact with said fixed corrugating die.

7. The assemblies as set forth in claim 1 wherein said one of said upper and lower corrugating die shoe assemblies is further provided with spaced apart ramps mounted on the primary bed member to opposite sides of said guide bars and shiftable corrugating dies, each of said spaced apart ramp members being capable of shifting an associated shiftable corrugating die inwardly towards the fixed corrugating die as the corrugating die shoe assemblies are moved from their open position to their closed position.

* * * * *